United States Patent [19]

Takeda et al.

[11] 4,348,997

[45] Sep. 14, 1982

[54] FUEL INJECTION TYPE CARBURETOR

[75] Inventors: Keiso Takeda; Shozo Inouye; Toshimi Kashiwakura, all of Susono, Japan

[73] Assignee: Toyota Jidosha Kogyo Kabushiki Kaisha, Aichi, Japan

[21] Appl. No.: 174,142

[22] Filed: Jul. 31, 1980

[30] Foreign Application Priority Data

Aug. 1, 1979 [JP] Japan ..... 54-97211

[51] Int. Cl.[3] ..... F02M 61/14

[52] U.S. Cl. ..... 123/445; 123/590; 261/44 E; 261/DIG. 82

[58] Field of Search ..... 123/445, 470, 472, 590, 123/52 M; 261/44 E, DIG. 82

[56] References Cited

U.S. PATENT DOCUMENTS

| | | | |
|---|---|---|---|
| 3,544,290 | 12/1970 | Larson, Sr. et al. | 48/180 |
| 3,827,411 | 8/1974 | Lamm et al. | 123/445 |
| 4,029,070 | 6/1977 | Kobayashi | 123/445 |
| 4,253,441 | 3/1981 | Kawamura et al. | 123/445 |

FOREIGN PATENT DOCUMENTS

| | | |
|---|---|---|
| 818884 | 7/1949 | Fed. Rep. of Germany . |
| 2910275 | 3/1979 | Fed. Rep. of Germany . |

*Primary Examiner*—Charles J. Myhre
*Assistant Examiner*—Andrew M. Dolinar
*Attorney, Agent, or Firm*—Stevens, Davis, Miller & Mosher

[57] ABSTRACT

Disclosed is a fuel injection type carburetor of a multi-cylinder internal combustion engine. The carburetor comprises: an intake manifold comprising a plurality of horizontal intake passages; a throttle body connected to a converging portion of said intake manifold; a throttle valve installed within said throttle body; and a fuel injector arranged downstream from said throttle valve in a manner such that injected fuel can impinge against at least a part of said throttle valve. An opening direction of a valve portion of said throttle valve against which portion injected fuel impinges is substantially the same as the direction of fuel injection from said fuel injector.

3 Claims, 17 Drawing Figures

FUEL INJECTION TYPE CARBURETOR

BACKGROUND OF THE INVENTION

The present invention relates to a fuel injection type carburetor, especially in a multicylinder internal combustion engine. In a prior proposed fuel injection type carburetor of a multicylinder internal combustion gasoline engine, one fuel injector is provided for each cylinder near an intake port in an intake manifold so as to inject fuel into the intake port of the corresponding cylinder from the fuel injector. Such a prior fuel injection type carburetor is advantageous in that the fuel can be evenly supplied into each of the cylinders. However, in such a prior carburetor, there are problems in that the fuel supplied into a combustion chamber is not sufficiently atomized and a plurality of fuel injectors are required.

In order to solve such problems, another fuel injection type carburetor has been proposed in which only one fuel injector is arranged at a converging portion of the intake manifold so that fuel is distributed into each of the cylinders from a single fuel injector. In this fuel injection type carburetor, it is desirable to electronically control the fuel injector so that a required amount of fuel in one combustion process in the combustion chamber of each cylinder can be intermittently supplied from the fuel injector at intervals synchronized with opening intervals of an intake valve of each cylinder. Each fuel injection must be fed into the combustion chamber of each cylinder in turn so as to obtain even fuel distribution to each cylinder.

However, in such a fuel injection type carburetor, the atomization characteristic of fuel and fuel distribution into each cylinder are affected by the location and the injection direction of the fuel injector or by the shape of the throttle valve or other parts.

SUMMARY OF THE INVENTION

The present invention was made considering the above points. It is an object of the present invention to provide a fuel injection type carburetor having a good atomization characteristic and an even distribution characteristic of fuel into each of the cylinders.

A fuel injection type carburetor of a multicylinder internal combustion engine according to the present invention comprises: an intake manifold comprising a plurality of horizontal intake passages; a throttle body connected to a converging portion of said intake manifold; a throttle valve installed within said throttle body, and; a fuel injector arranged downstream from said throttle valve in a manner such that injected fuel can impinge on at least a part of said throttle valve. A valve portion of said throttle valve, against which portion fuel is injected, opens in a direction which is the same as the direction of the fuel injection. Also, in a carburetor according to the present invention, injected fuel impinges against the valve portion of said throttle valve when said valve is in an opening range from a small or middle through a full opening.

DETAILED DESCRIPTION OF THE PREFERRED EMBODIMENTS OF THE INVENTION

Figure 1:
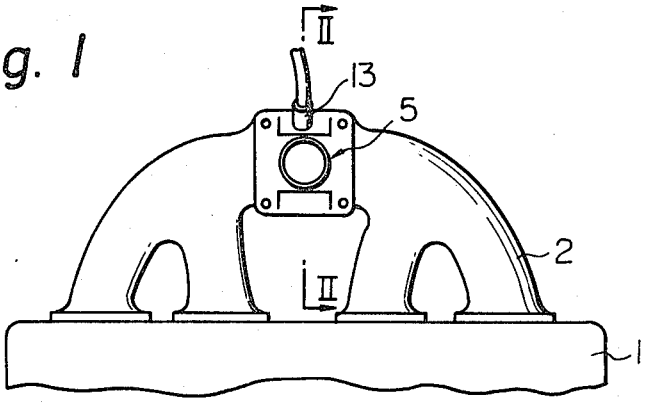
FIG. 1 is a plan view of a part of a multicylinder internal combustion engine.
Figure 2:
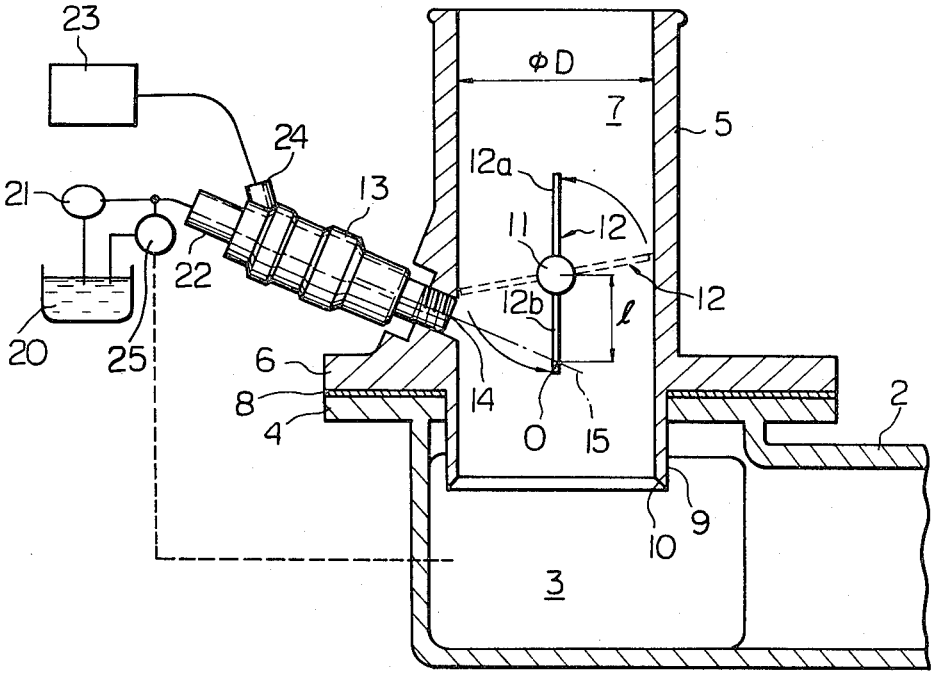
FIG. 2 is a sectional view taken along a line II—II in FIG. 1, illustrating an embodiment of a fuel injection type carburetor according to the present invention.

Referring to FIGS. 1 and 2, an intake manifold 2 is secured to a multicylinder internal combustion engine body 1. As can be seen from FIG. 2, the intake manifold 2 extends substantially in a horizontal direction. Manifold passages converge at a converging portion 3. A horizontal manifold flange 4, integral with the intake manifold 2 is provided on the converging portion 3 of the intake manifold 2. A substantially cylindrical shaped throttle body 5 has a connecting flange 6 integral therewith at its lower end portion. A cylindrical throttle bore 7 extends in a vertical direction within the throttle body 5. The throttle bore 7 has substantially a uniform diameter. As can be seen from FIG. 2, the connecting flange 6 of throttle body 5 is joined with the manifold flange 4 through a gasket 8. In such a manner, the throttle bore 7 communicates with the converging portion 3 of the intake manifold 2 and extends vertically upward from the converging portion 3.

The throttle body 5 has a thin cylindrical elongated portion 9 formed integrally therewith at its lower end portion. The elongated portion 9 projects into the inner space of the converging portion 3 of the intake manifold 2. A lower edge 10 of the elongated portion 9 is pointed by being slanted toward the outside of the throttle body 5 as illustrated in FIG. 2. This lower edge 10 is spaced apart from the inside surface of the converging portion 3 of the intake manifold 2.

Figure 3:
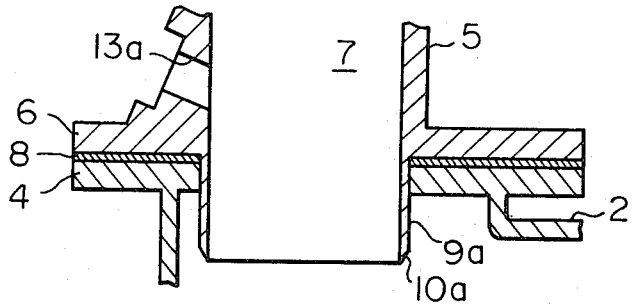
FIGS. 3 through 5 are sectional views of different examples of an elongated lower end portion of a throttle body.
Figure 4:
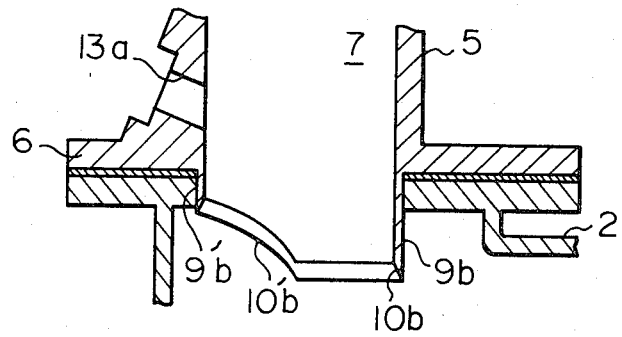
Figure 5:
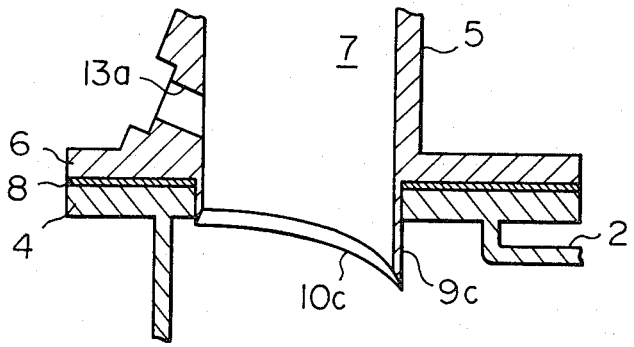

Other examples of the elongated portion 9 each of which projects into the space within the converging portion 3 of the intake manifold 2 are illustrated in FIGS. 3 through 5. In FIG. 3, a lower edge 10*a* of a thin cylindrical elongated portion 9*a* is pointed by being slanted toward the inside of the throttle body 5. In FIG. 4, 13*a* designates a mounting location of a fuel injector 13 which will be described later. An elongated portion 9*b* is formed along one half of the perimeter of the throttle bore 7, which half of the perimeter of the throttle bore 7 is farthest from the location 13*a* of the fuel injector 13. A lower edge 10*b* of the elongated portion 9*b* is pointed by being slanted toward the outside of the throttle body 5. Another elongated portion 9'*b* is formed on the side of the throttle bore 7 which side is the same as the side of the location 13*a* of the fuel injector 13. This elongated portion 9'*b* increases in length as it extends along the perimeter of the throttle bore 7 from a position beneath the location 13*a* of the fuel injector 13 to a center position of the side wall of the throttle body 5. A lower edge 10'*b* of this elongated portion 9'*b* is also pointed by being slanted toward the outside of the throttle bore 7. This lower edge 10'*b* is communicated to the lower edge 10*b* of the elongated portion 9*b* at a center position of the side wall of the throttle body 5. In FIG. 5, an elongated portion 9*c* is formed in the lower end of the throttle body 5. This elongated portion 9*c* increases its length as it extends along the lower portion of the perimeter of the throttle body 5 from a portion of the throttle body 5 near the location 13*a* of the fuel injector 13 to a portion on the opposite side of the throttle body 5. A lower edge 10*c* of this elongated portion 9*c* is also pointed by being slanted toward the outside of the throttle bore 7.

Referring again to FIG. 2, a throttle shaft 11 is installed within the throttle bore 7. A throttle valve 12 having a butterfly valve shape is secured to the throttle shaft 11. The throttle shaft 11 intersects the center axis of the throttle bore 7 and extends perpendicularly to the direction of air flow through the throttle bore 7. The throttle valve 12 comprises a valve 12*a* and a valve 12*b* which valve 12*b* extends in an opposite direction from the valve 12*a*. The valve 12*a* moves within the right region in FIG. 2 while the valve 12*b* moves within the left region in FIG. 2. The throttle shaft 11 of the throttle valve 12 is connected to an accelerator pedal (not shown) of a vehicle. When a driver steps on the accelerator pedal, the throttle valve 12 rotates in the counterclockwise direction in FIG. 2 so as to open the passage of the throttle bore 7. This condition is illustrated by solid lines in FIG. 2. When the accelerator pedal is released, the throttle valve 12 rotates in a clockwise direction in FIG. 2 so as to close the passage of the throttle bore 7. This condition is illustrated by dotted lines in FIG. 2.

A straight injection type fuel injector 13 is mounted on the throttle body 5 downstream from the throttle valve 12 which is within the throttle bore 7. The fuel injector 13 is located at a side which is opposite a side of the throttle body 5 to which side the engine body 1 and the intake manifold 2 are communicated. An injection nozzle 14 of this fuel injector 13 is inclined downward as illustrated in FIG. 2. Therefore, the injected fuel from the nozzle 14 is directed obliquely downward, i.e., substantially in the same direction as the air flow direction in the intake manifold 2.

The relation between the fuel injector 13 and the throttle valve 12 will be further described hereinafter. In an opening operation of the throttle valve 12, the valve 12*b* which is disposed on the underside of the throttle shaft 11 in FIG. 2 rotates substantially in the same direction as the fuel injection direction from the fuel injector 13. When the throttle valve 12 is opened to a certain extent, the fuel jet from the nozzle 14 of the fuel injector 13 abuts against the lower valve 12*b* of the throttle valve 12. For this purpose, the mounting location 13*a* and angle of the fuel injector 13 are such that a length (l) is smaller than one half of the inner diameter (D) of the throttle bore 7, which length (l) is the length from the throttle shaft 11 to an intersection point 0 of a center axis 15 of the fuel nozzle 14 and the throttle valve 12, when the throttle valve 12 is in a fully opened position.

The straight injection type fuel injector 13 injects a fuel jet in a nearly straight direction. Such a straight type fuel injector has a simple construction as compared with a swirl injection type fuel injector which generates a swirl motion of fuel within the injector and injects a fuel jet at an angle of 60 through 120 degrees. Further explanation concerning the construction of the straight injection type fuel injector is omitted here since it is already known to persons skilled in the art.

A fuel supply system and an electrical system of the fuel injector 13 are as follows. Fuel within a fuel tank 20 is supplied to the fuel injector 13 by a pump 21 through a fuel pipe 22. A control voltage signal is transmitted from an electronic control unit 23 to the fuel injector 13 through a connector 24. By this arrangement, the fuel injector 13 intermittently injects the required amount of fuel for one process of combustion into the combustion chamber of each cylinder synchronously with an opening time of an intake valve of each cylinder. Reference number 25 designates a pressure regulator which is actuated by the intake vacuum so as to control the amount of fuel returned.

In FIG. 2, the throttle valve 12 rotates in a counterclockwise direction from a closed position to a fully opened position as indicated by arrows in the drawing. As can be understood from the drawing, an injected fuel jet abuts against the lower valve portion 12*b* when the throttle valve 12 is opened to a certain extent when the engine is operated under a moderate or high-load. By such an arrangement, injected fuel is turned into minute particles and can be sufficiently atomized. Some minute particles abut against the elongated portion 9 before entering the converging portion 3 of the intake manifold 2. Then, at the pointed lower edge 10 of the elongated portion 9, the minute particles are further fractionized. Liquid fuel which flows along the inside wall of the throttle bore 7 to the lower edge 10 is also fractionized into minute particles by the air/fuel mixture flow. Therefore, fuel atomization is further promoted. When the engine is operated under a light load and the opening of the throttle valve 12 is very small injected fuel from the nozzle 14 of the fuel injector 13 is sufficiently atomized since the intake vacuum pressure is very high. A part of the fuel directly abuts against the elongated portion 9 and is fractionized at the pointed lower edge 10, which promotes the atomization of fuel. When an engine is operated under a light or moderate load, the air flow speed through the space between the valve 12*b* and the inner surface of the throttle bore 7 is faster than that through the space between the valve 12*a* and the inner surface of the throttle bore 7. Since the nozzle 14 of the fuel injector 13 is disposed facing the air flow of a faster speed, atomization of fuel is further promoted. The atomized fuel flows into one of the passages of the intake manifold 2 through the converging portion 3. Since fuel is injected from the nozzle 14 of the injector 13 substantially in the same direction as the direction of intake air flow through the intake manifold 2, the atomized fuel flows smoothly into the intake manifold 2 through the converging portion 3. Thus, well-atomized fuel is supplied into a predetermined combustion chamber at stable time intervals. Therefore, fuel can be evenly supplied into each of the cylinders.

Figure 6:
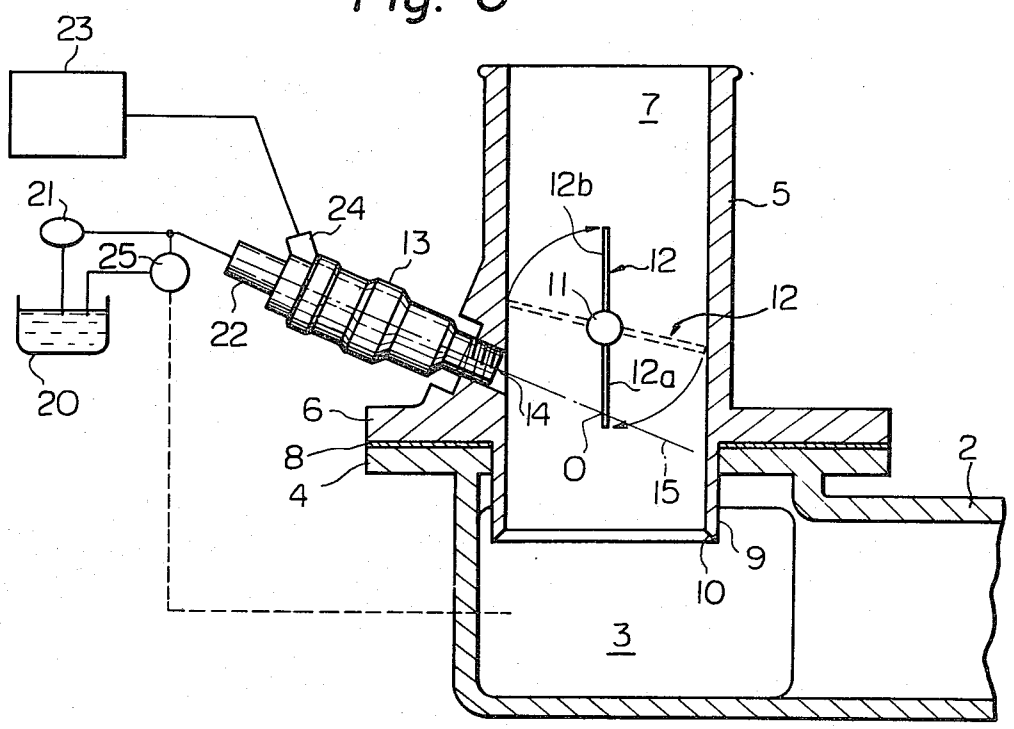
FIG. 6 is a sectional view similar to FIG. 2, illustrating another embodiment of the present invention.

Another embodiment of the present invention is illustrated in FIG. 6. The embodiment of FIG. 6 is different from the embodiment of FIG. 2 in that the throttle valve 12 opens in a clockwise direction in FIG. 6. In this embodiment, a fuel jet from the nozzle 14 of the injector 13 abuts against the valve portion 12*a* of the throttle valve 12, so as to promote atomization of fuel when the engine is operated under a heavy load, in which the throttle valve 12 is relatively widely opened. When the engine is operated under a light or moderate load, the fuel jet is atomized by the intake vacuum. A part of the fuel jet directly abuts against the elongated portion 9 and becomes minute particles due to the air flow at the pointed lower edge 10 of the elongated portion 9.

Figure 7:
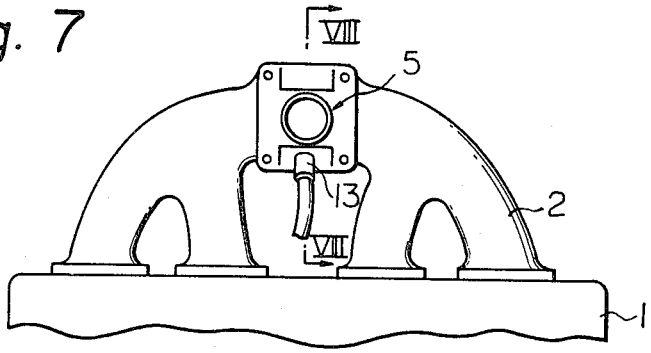
FIG. 7 is a plan view of a part of a multicylinder internal combustion engine, in which the location of a fuel injector is modified.
Figure 8:
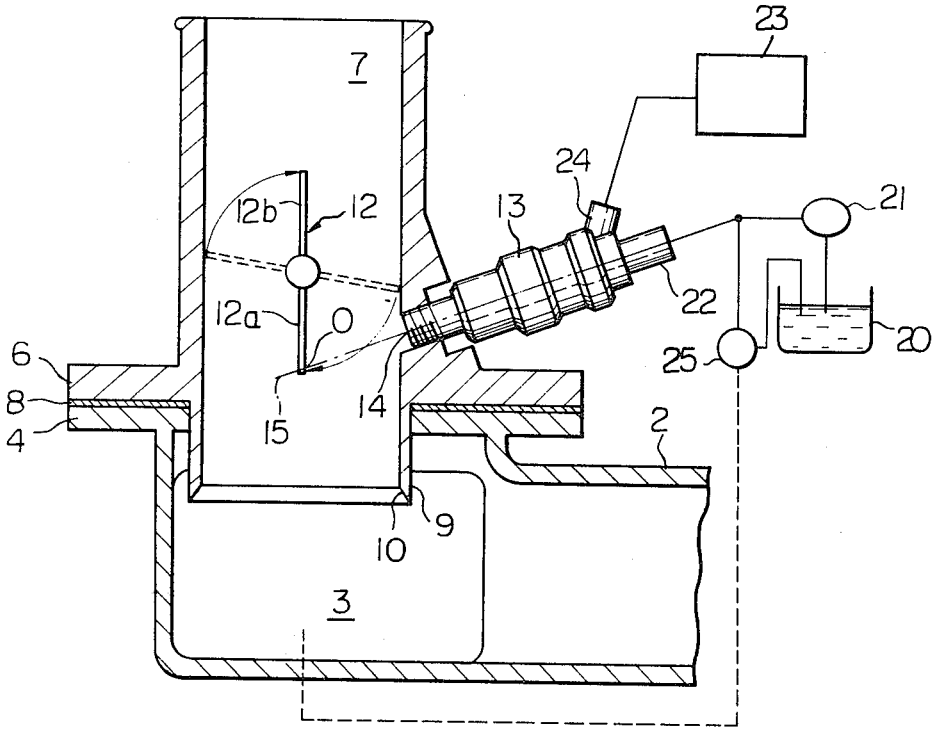
FIG. 8 is a sectional view taken along a line VIII—VIII in FIG. 7, illustrating another embodiment of a fuel injection type carburetor according to the present invention.
Figure 9:
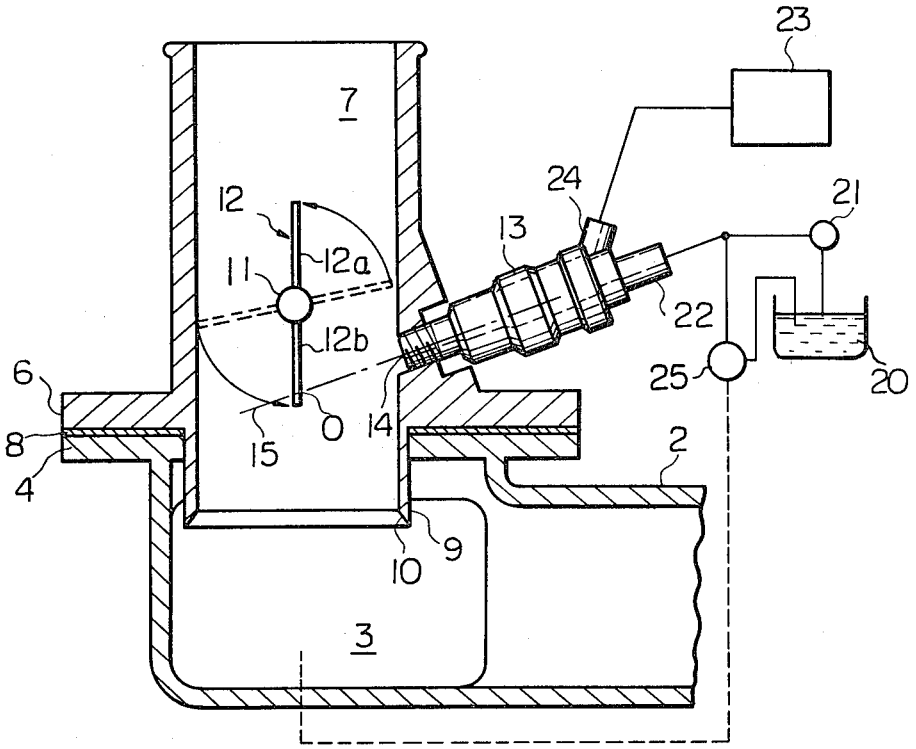
FIG. 9 is a view similar to FIG. 8, illustrating a further embodiment of the present invention.

Still other embodiments of the present invention are illustrated in FIGS. 7 through 9. In these embodiments, the location of the fuel injection 13 is different from that in the above-mentioned embodiments. The fuel injector 13 is disposed in the same side as the intake manifold 2 and the engine 1. The fuel injection direction from the nozzle 14 of the fuel injector 13 is substantially opposite to the direction of fuel/air mixture flow through the intake manifold 2. In the embodiment of FIG. 8, the throttle valve 12 rotates in clockwise direction when the engine load is changed from light to heavy. Therefore, the opening direction of the throttle valve 12 is the same as the fuel injection direction from the injector 13, as is the case in the embodiment of FIG. 2. In the embodiment of FIG. 9, the throttle valve 12 rotates in a counter-clockwise direction when the engine load is changed from light to heavy. Therefore, the opening direction of the throttle valve 12 is opposite to the fuel injection direction from the injector 13, as is the case in the embodiment of FIG. 6.

Figure 10A:
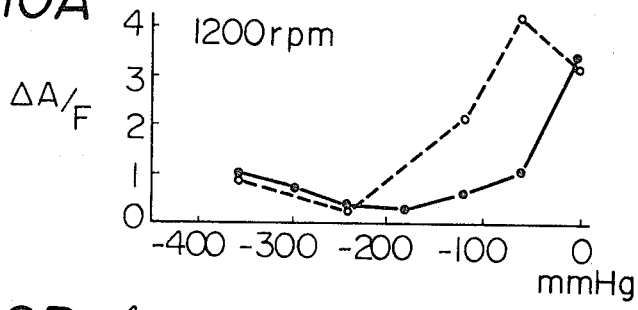
FIGS. 10A, 10B, 11A and 11B are graphical views of experimental data representing the dispersion difference of an air/fuel ratio between cases in which the opening direction of the throttle valve is the same as the direction of a fuel injection and cases in which said directions are not the same.
Figure 10B:
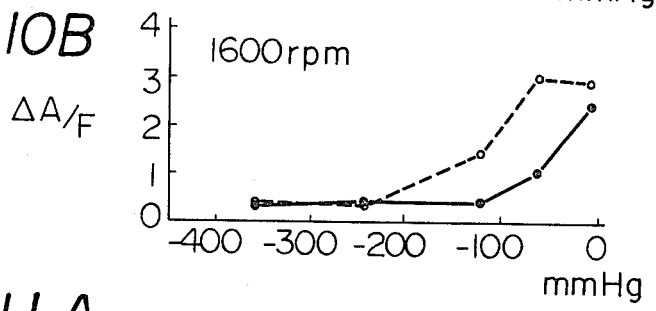

Effects of the present invention will now be further explained with reference to FIGS. 10 through 12. In FIGS. 10A and 10B, graphical views are illustrated in which there are represented experimental data of dispersion differences of air/fuel ratios between cases when the opening direction of the throttle valve 12 is the same as the direction of the fuel injection and cases when the direction of the throttle valve 12 is opposite to that of the fuel injection. In FIGS. 10A and 10B, the abscissas represent the intake vacuum (mmHg) and the ordinates represent dispersion of the air/fuel ratio among cylinders of a four cylinder engine, i.e. the air/fuel ratio difference between a cylinder of maximum air/fuel ratio and a cylinder of minimum air/fuel ratio. The engine revolution speed is 1,200 rpm in FIG. 10 (A), while it is 1,600 rpm in FIG. 10 (B). In each of the two figures, a solid line represents cases when the opening direction of a valve portion of the throttle valve 12, against which portion injected fuel abuts is the same as the direction of fuel injection, while a dotted line represents cases when the opening direction of the valve portion is opposite to the direction of fuel injection. As can be understood from FIGS. 10A and 10B, especially in an intake vacuum range of between about 50 and 200 mmHg, the air/fuel ratio dispersion is small in a case when the opening direction of the throttle valve 12 is the same as the direction of the fuel injection as compared with a case when the opening direction of the throttle valve is opposite to the direction of the fuel injection. Therefore, stable combustion and stable engine output can be obtained in cases when the opening direction of the throttle valve is the same as the direction of the fuel injection. Also, such a case is advantageous from the viewpoint of fuel consumption and emission control as the air/fuel ratio dispersion is small.

Figure 11A:
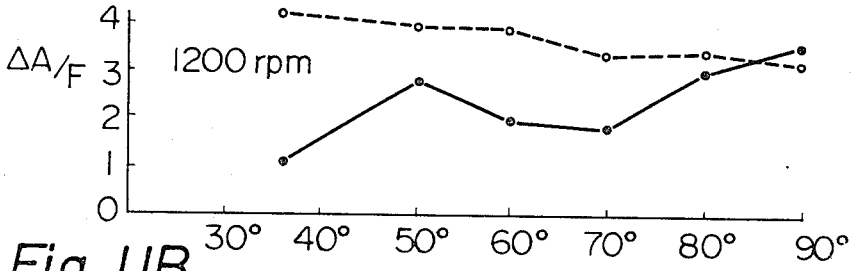
Figure 11B:
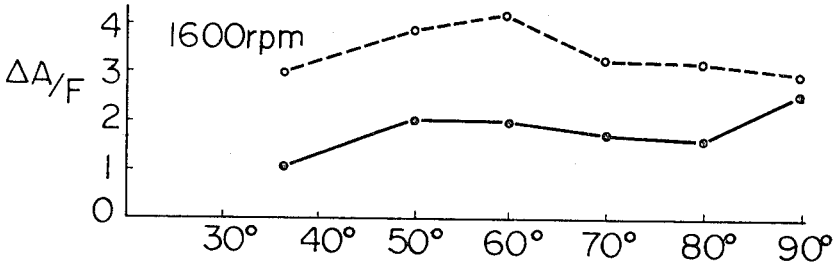
Figure 12A:
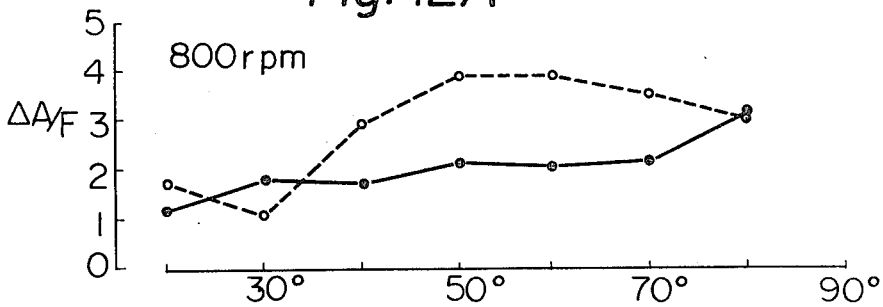
FIGS. 12A, 12B, 12C, and 12D are graphical views of experimental data representing dispersion differences of an air/fuel ratio between a case in which an initial impinging opening angle of the throttle valve with the injected fuel is small and a case in which an initial impinging opening angle of the throttle valve with the injected fuel is large.
Figure 12B:
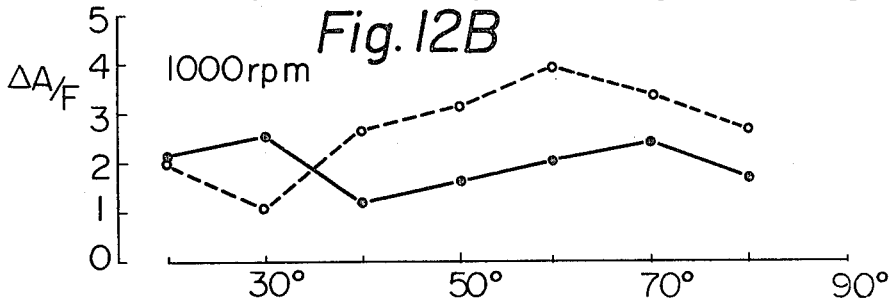
Figure 12C:
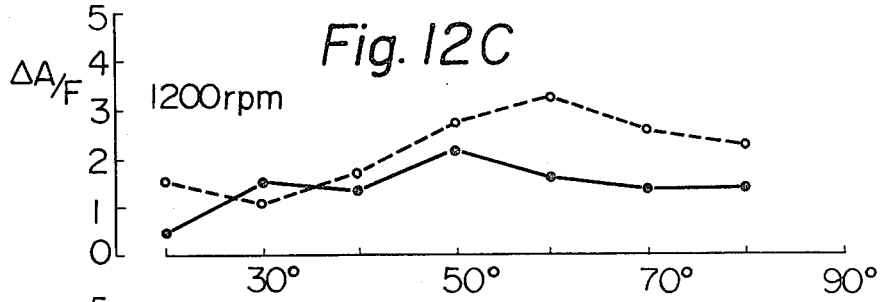
Figure 12D:
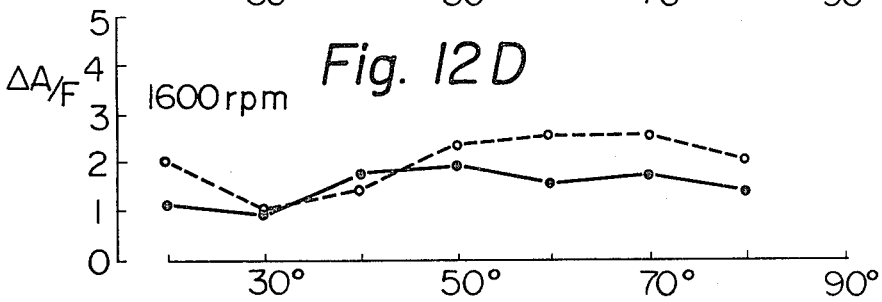

In FIGS. 11A and 11B, as in FIGS. 10A and 10B, graphical views of experimental data are illustrated representing dispersion differences of air/fuel ratios between cases when the opening direction of the throttle valve 12 is the same as the direction of the fuel injection and cases in which the opening direction of the throttle valve 12 is opposite to that of the fuel injection. In the graphs of FIGS. 11(A) and 11(B), the abscissas represent opening angles of the throttle valve 12 (fully open: 90°), while the ordinates represent air/fuel ratio dispersion among cylinders. The engine revolution speed is 1,200 rpm in FIG. 11A, while it is 1,600 rpm in FIG. 11B. At points in FIGS. 11A and 11B where the opening angle is about 35° (at the left of graphs), intake vacuum is about −60 mmHg, while at the points in FIGS. 11A and 11B where the opening angle is 90° (at the right of the graphs), intake vacuum is 0 mmHg. In FIGS. 11A and 11B, a solid line represents cases when the opening direction of the throttle valve 12 is the same as the direction of the fuel injection, while a dotted line represents cases where the opening direction of the throttle valve 12 is opposite to the direction of the fuel injection. As can be understood from the graphs, air/fuel ratio dispersion is small in cases when the opening direction of the throttle valve 12 is the same as the direction of the fuel injection as compared with cases when the opening direction of throttle valve 12 is opposite to the direction of the fuel injection.

In FIGS. 12A through 12D experimental data are graphically illustrated, representing dispersion differences of air/fuel ratios between cases when the initial abutting opening angle of the throttle valve 12 is small, at a point where the injected fuel starts to impinge on the throttle valve 12 and cases when said initial abutting opening angle is wide. In the graphs of FIGS. 12(A), 12(B), 12(C) and 12(D), engine revolution speeds are 800 rpm, 1,000 rpm, 1,200 rpm and 1,600 rpm, respectively. In each of these graphs, the abscissa represents opening angles of the throttle valve 12 (fully open: 90°), while the ordinate represents air/fuel ratio dispersion among cylinders. In each of these graphs, a solid line represents cases when the injected fuel abuts against the throttle valve 12 from an opening angle of 41° while the dotted line represents cases when the injected fuel abuts against the throttle valve 12 from an opening angle of 62°. In each case, the opening direction of the throttle valve 12 is the same as the direction of the fuel injection. In each graph, the solid line essentially shows smaller air/fuel ratio dispersion than does the dotted line. That is, air/fuel ratio dispersion is smaller in a construction in which the injected fuel abuts against the valve portion of the throttle valve 12 at an opening angle from small through fully opened, than in a construction in which the injected fuel abuts against the valve portion of the throttle valve 12 only when it is almost fully or fully open.

We claim:

1. A fuel injection type carburetor of a multicylinder internal combustion engine comprising:

an intake manifold comprising a plurality of horizontal intake passages;

a throttle body connected to a converging portion of said intake manifold;

a throttle valve having a pivot axis installed within said throttle body; and a fuel injector having a nozzle for injecting fuel in a direction defined by a center axis of said nozzle arranged downstream from the pivot axis of said throttle valve in a manner such that injected fuel can impinge against at least a part of said throttle valve, in which an opening direction of a valve portion of said throttle valve which can be intersected by said center axis and against which portion the injected fuel impinges is substantially the same as the direction of the fuel injection from said fuel injector, and in which said fuel injector is disposed so that the direction of its nozzle is substantially the same as the direction of air flow through said horizontal intake passages of said intake manifold.

2. A fuel injection type carburetor according to claim 1, in which said fuel injector is arranged so that injected fuel impinges against a valve portion of said throttle valve in an opening range at least from a middle through a full opening.

3. A fuel injection type carburetor of a multicylinder internal combustion engine comprising:

an intake manifold comprising a plurality of horizontal intake passages;

a throttle body connected to a converging portion of said intake manifold;

a throttle valve having a pivot axis installed within said throttle body; and a fuel injector having a nozzle for injecting fuel in a direction defined by a center axis of said nozzle arranged downstream from the pivot axis of said throttle valve in a manner such that injected fuel can impinge against at least a part of said throttle valve, in which an opening direction of a valve portion of said throttle valve which can be intersected by said center axis and against which portion the injected fuel impinges is substantially the same as the direction of the fuel injection from said fuel injector, and in which said fuel injector is disposed so that the direction of its nozzle is pointed slightly downward and in substantially the same direction as the air flow through said horizontal intake passages of said intake manifold, and in which the injected fuel further impinges against an elongated portion of said throttle body.

* * * * *